US005319193A

United States Patent [19]

Rogers et al.

[11] Patent Number: 5,319,193

[45] Date of Patent: Jun. 7, 1994

[54] LIGHT ACTIVATED TRANSDUCER

[75] Inventors: Tony W. J. Rogers, Reading; Carol D. Daniel, London; Andrew Holmes-Siedle, Eynsham, all of England

[73] Assignee: British Technology Group Limited, London, England

[21] Appl. No.: 923,981

[22] PCT Filed: Mar. 28, 1991

[86] PCT No.: PCT/GB91/00485

§ 371 Date: Sep. 14, 1992

§ 102(e) Date: Sep. 14, 1992

[87] PCT Pub. No.: WO91/15028

PCT Pub. Date: Oct. 3, 1991

[30] Foreign Application Priority Data

Mar. 28, 1991 [GB] United Kingdom ..... 9006920

[51] Int. Cl.[5] ..... H01J 40/14

[52] U.S. Cl. ..... 250/214.1; 313/538

[58] Field of Search ..... 250/214.1; 313/538, 313/539, 532, 523

[56] References Cited

U.S. PATENT DOCUMENTS 4,761,548 8/1988 Laul ..... 250/211 J 4,771,168 9/1988 Gundersen et al. ..... 250/211 R

FOREIGN PATENT DOCUMENTS 0274275 7/1988 European Pat. Off. .

OTHER PUBLICATIONS

Nuclear Instruments & Methods In Physics Research. vol. A 251, No. 1, Oct. 1986, Amsterdam NL pp. 196–198 R. Bellazzini et al. : "High Resolution Digital Autoradiography of Short and Long Range Emitters Using a Single Step Parallel Plate Chamber".

Review Of Scientific Instruments. vol. 57, No. 9, Sep. 1986, New York US pp. 2234–2237; A. F. Borghesani et al. : "Simple photoelectronic source for swarm experiments in high-density gases".

*Primary Examiner*—Edward P. Westin

*Assistant Examiner*—T. Davenport

*Attorney, Agent, or Firm*—Cushman, Darby & Cushman

[57] ABSTRACT

A light-activated transducer includes a transparent electrically-insulating substrate (2) having on one surface an electrode structure. The electrode structure includes an electrode portion (5*a*) containing an aperture for passage therethrough of light which has passed through the substrate, a contact pad (5*c*) spaced from the electrode portion, and an electrical feedthrough (5*b*) connecting the electrode portion to the contact pad. An insulator layer (3) is adhered to the surface of the substrate and on the feedthrough, and surrounds the electrode portion while leaving uncovered the contact pad and the electrode portion and a corresponding region of the substrate. A conductive or semiconductive cover sheet (1) is adhered to the insulator layer and supported thereby in spaced overlying relationship with the electrode portion and the corresponding region of the substrate. The, cover sheet, insulator layer, and the substrate form a cavity that, when sealed, contains an ionisable gaseous filling.

21 Claims, 2 Drawing Sheets

LIGHT ACTIVATED TRANSDUCER

This invention relates to a light-activated transducer and to a method of making it.

A known radiation-activated transducer (the "cold cathode gas discharge tube") has two electric leads sealed into a glass phial filled with a mixture of helium and hydrogen, the leads being spaced just further apart inside the phial than the discharge gap at a given voltage. On irradiation with ultra-violet light or ionising radiation, the given voltage being applied between the leads, the gas ionises sufficiently for electric discharge to occur between the leads. A photon or particle produces a short burst of current.

Such a switch has utility in being able to detect instantly a very low flux of radiation by virtue of signal amplification in the gas. The output is easily monitored, being in discrete pulses of current.

This type of transducer is manufactured by letting leads into glass tubes in an appropriate atmosphere and sealing the tubes individually to form phials. This form of assembly can be costly, occupies an excessive volume and requires a cathode to anode voltage in the region of 300V.

It is an object of the present invention to provide a light-activated transducer which can be made using mass-production techniques typical of the semiconductor industry and which is susceptible of miniaturisation and a consequent reduction of the voltage it requires in operation.

According to the present invention, there is provided a light-activated transducer comprising a transparent electrically-insulating substrate, an electrode structure applied to a surface of the substrate and supported thereby and comprising an electrode portion apertured for passage therethrough of light incident on a corresponding region of the substrate, a contact pad spaced from the electrode portion, and an electrical feedthrough connecting the electrode portion to the contact pad, an insulator layer adhered on the said surface of the substrate and on the feedthrough, and surrounding the electrode portion while leaving uncovered the contact pad and the electrode portion and the corresponding region of the substrate, a conductive or semiconductive cover sheet adhered on the insulator layer and supported thereby in spaced overlying relationship with the electrode portion and the corresponding region of the substrate and forming therewith, and with the surrounding insulator layer, a sealed cavity, and within the cavity an ionisable gaseous filling.

According, therefore, to another aspect of the invention there is provided a method of making a light-activated transducer which comprises applying to a surface of a transparent electrically-insulating substrate an electrode structure comprising an electrode portion apertured for passage therethrough of light incident on a corresponding region of the substrate, a contact pad spaced from the electrode portion, and an electrical feedthrough connecting the electrode portion to the contact pad, adhering on the said surface of the substrate and on the feedthrough an insulator layer formed to surround the electrode portion while leaving uncovered the contact pad and the electrode portion and the corresponding region of the substrate, and, in a suitable gaseous atmosphere, applying a conductive or semiconductive cover sheet on the insulator layer to be adhered and supported thereby in spaced overlying relationship with the electrode portion and the corresponding region of the substrate and forming therewith, and with the surrounding insulator layer, a sealed cavity filled with the said atmosphere as an ionisable gaseous filling.

In a preferred way of carrying out this method according to the invention, after the cover sheet has been applied on the insulator layer the whole assembly is heated and a voltage is applied between the substrate and the cover sheet to promote electrostatic bonding between the insulator layer and the substrate and/or the cover sheet.

The substrate is conveniently glass (such as a borosilicate glass) having significant transmission in the blue or UV, preferably with a thermal expansion coefficient matched to that of the conductive or semiconductive cover sheet, which would usually be single-crystal silicon. Suitable proprietary glasses include Corning 7070, Schott 8248 and 8337 and Corning 1729. Schott 8337 allows the broadest range of wavelength of usage.

The electrode structure is conveniently applied to the substrate surface by metal deposition, preferably performed imagewise by techniques well established in the microelectronics industry, such as photolithography, to a thickness of a fraction of a micron, such as 0.05 μm. The electrode structure may be of a two-layer construction, for example a layer of nickel chromium (NiCr) and a layer of gold (Au), although other metal combinations and alloys may be employed, especially chromium or molybdenum in place of NiCr, to a thickness of say 0.05 μm. The nickel chromium provides a very good adhesion to a glass substrate and gold provides a low resistivity electrical path. NiCr or Cr or any other suitable metal (e.g. Al, Ti, Mo) can be plated on the underside of the glass, too, to improve field uniformity during the electrostatic bonding, but must then be removed, at least where the holes are to be. The electrode portion of the electrode structure, inside the cavity, may be shaped, as a mesh or ring containing spaces, or otherwise apartured, so as to allow light to penetrate to the semiconductive or conductive cover sheet.

The insulator layer can conveniently be silicon dioxide $SiO_2$ or silicon nitride $Si_3N_4$, applied typically to a depth of up to 3 μm. Both these materials deposit equally successfully over metal (i.e. the feedthrough) and over glass.

The insulator layer should not be too thick for successful electrostatic bonding. Otherwise, the thicker the insulator layer, the better the electrical isolation of the electrode structure and the lower the parasitic capacitance. For thicker insulators, an alternative method is required, namely the use of a self-supporting thin sheet of insulator with holes machined to the pattern as before. A suitable thickness to be formed by lapping is 10 micrometres.

The electrostatic bonding (using perhaps a voltage of 300V with the substrate (e.g. glass) as the negative electrode) is strong enough to seal the cavity hermetically. It tends to withdraw cations from the bonding surface of the glass yielding an immobile $SiO_2$ skeleton.

The invention will now be described by way of example with reference to FIGS. 1 to 4 of the accompanying drawings in which.

Figure 1:
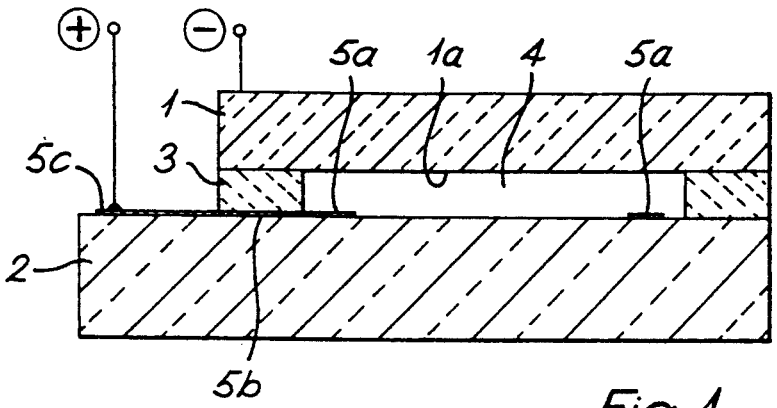
FIG. 1 is a cross-section of a light-activated transducer according to the invention.
Figure 2:
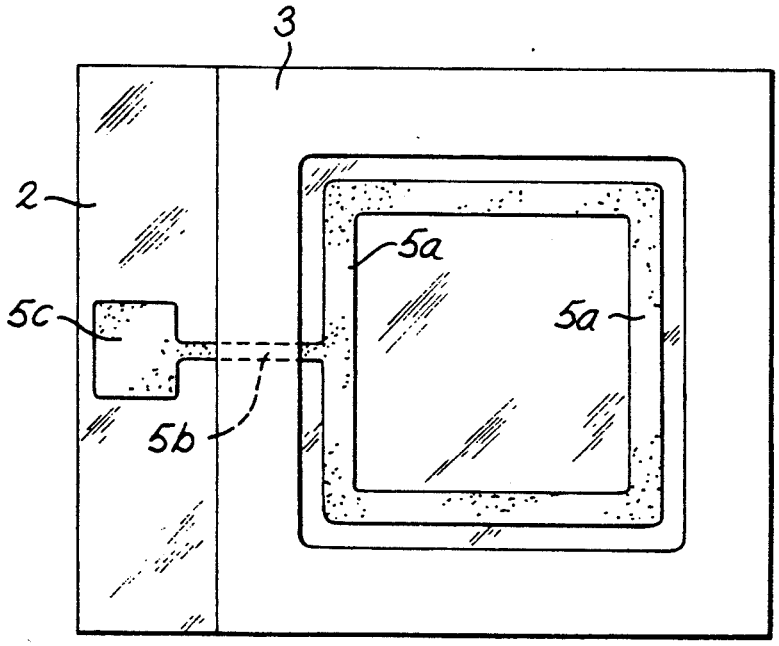
FIG. 2 is a plan of the transducer of FIG. 1, with the top layer removed for clarity.
Figure 3:
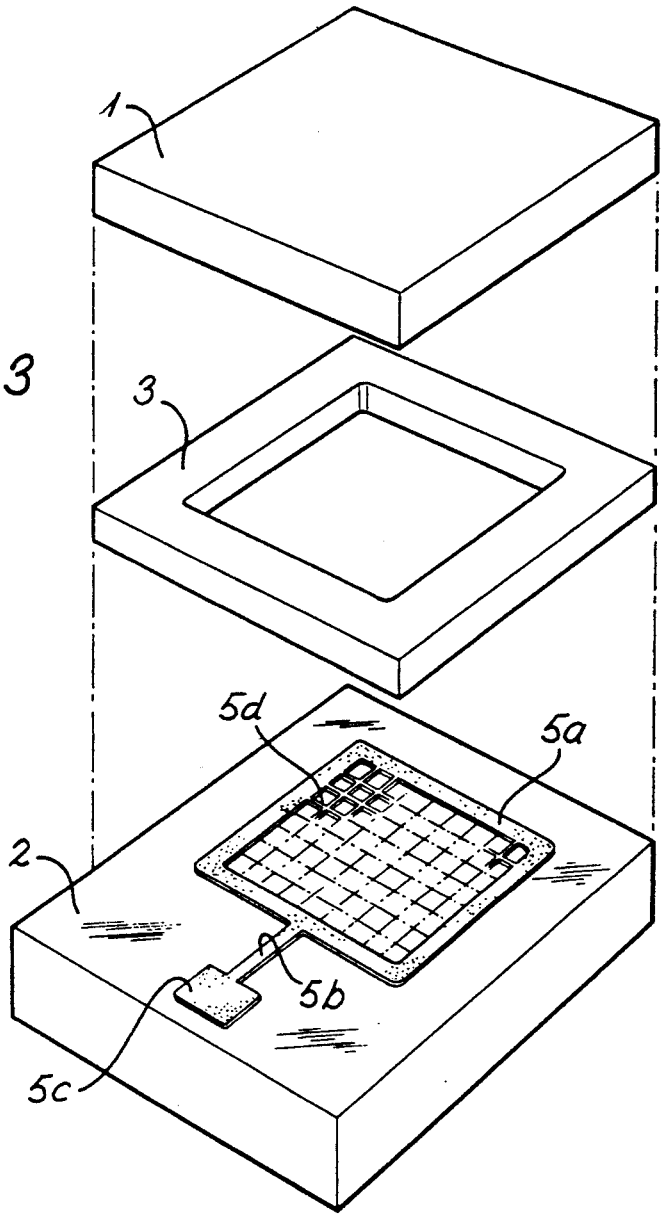
FIG. 3 is an exploded view of the transducer of FIGS. 1 and 2.

The light-activated transducer of FIGS. 1 to 3 comprises a 2 mm square cathode of semiconductive material (silicon) 300 μm thick in the form of a cover sheet 1 bonded to a non-conductive substrate 2 (glass as described), with an intervening 2 μm-to-200 μm-thick annular insulator layer 3 e.g. of deposited silicon nitride 3 μm thick or apartured glass sheet 10 μm thick surrounding and defining a cavity 4. The substrate 2 is thick enough to give the transducer such mechanical rigidity as it needs (e.g. ¼ mm) and carries one or more metallic anodes (collectors) formed as a layer of gold on NiCr which are disposed between the semiconductive cover sheet I and the substrate 2 and each of which is the electrode portion 5*a* of an electrode structure which also comprises an electrical feedthrough 5*b* and a contact pad 5*c* extending therefrom and terminating at a point beyond an edge of the semiconductive material I for connection to external circuitry. Such an arrangement, a hermetically sealed cavity 4 between the substrate 2 and the silicon 1, is common in capacitive pressure sensors, accelerometers, etc., and the semiconductor technology learned in the microelectronics industry may be adapted to manufacture this transducer. The silicon cover sheet I may be polished or otherwise treated on its surface 1*a* facing the substrate 2, as will be described. The anode 5*a* i s shown in FIG. 2 as simply an annulus, but optionally the region within it may be formed with a mesh structure 5*d* in electrical connection with it as illustrated in FIG. 3.

The cavity 4 contains a hydrogen-helium mixture at a pressure of 100 torr. The electrodes have a gap between them of 2 to 200 micrometres. The distance that a voltage of 30 volts applied between 5*a* and I can spontaneously discharge through the cavity 4 is about 3 micrometres.

If a flux of photons (of visible, ultraviolet or ionising radiation) reaches the helium-filled cavity 4, through the glass 2 within the annulus or mesh formed by the anode 5*a*, the photons of energy above a certain value (an energy threshold) cause photoelectrons to be emitted from illuminated surfaces (principally the polished or otherwise treated face of the cathode 1). Each photoelectron is accelerated by the applied field. At a certain velocity it will ionise the gas and an avalanche current may result. In certain gases, the current is quenched spontaneously. The result is a discrete burst of current, representing a "count" in the output register circuit (O.R.). The selection of cathode surface material or the coating of existing surfaces can be used to adjust the photon energy threshold widely. For bare metals, the photon energy required lies between 5.32 eV (corresponding to a photon wavelength of 233 nanometres and a platinum surface) and 1.9 eV (corresponding to 652 nanometres and a cesium surface). For common metals and silicon, the photon threshold wavelength lies in the ultraviolet (silicon 3.6 eV, 344.4 nanometres; tungsten 4.5 eV, 275 nanometres). The choice of operating light wavelength will determine the choices of (a) the cathode inner surface material 1*a* and (b) the maximum thickness of the glass substrate 2, bearing in mind its light transmission coefficient at a given wavelength. Photons or charged particles in the kilovolt or megavolt range may be capable of penetrating the enclosure will also produce secondary electrons capable of initiating a current burst.

The cathode surface la can either be an untreated semiconductor or a metal or it can be coated with a photo-emitting layer having a suitable threshold energy.

Figure 4:
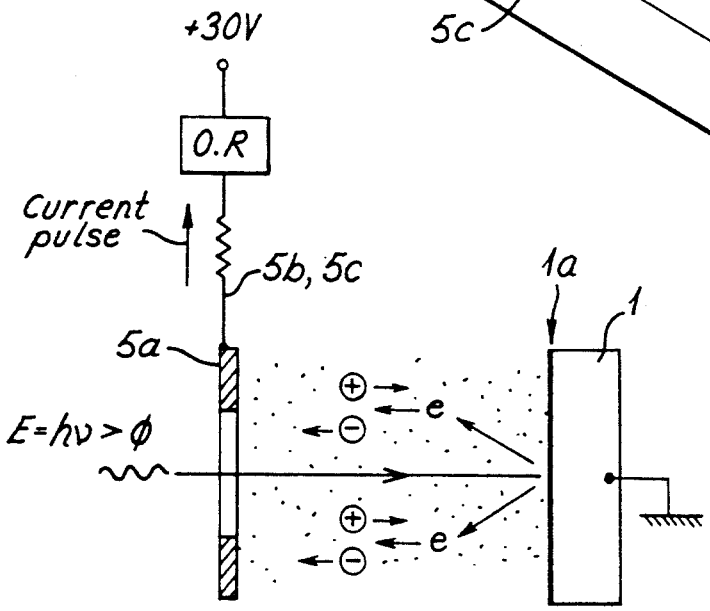
FIG. 4 is a diagram showing the operation of the transducer of FIGS. 1—3.

The resultant transducer action is shown diagrammatically in FIG. 4. Out of an incident flux which is of the order of microwatts per square centimetre, consider a photon of sufficiently short wavelength that its energy $E=h\nu$ exceeds the work function of the cathode surface 1*a*. The annular insulating layer 3 is omitted for clarity, but the anode 5*a* is shown, held at (for example) +30V with respect to the cathode I which is at ground potential. Light passes through the anode 5*a* on the glass substrate 2. Photoelectrons emitted from the cathode surface la are accelerated by the electric field towards the anode 5*a*. As mentioned, at a certain velocity they will ionise the hydrogen-helium mixture, and a burst of current of the order of milliamperes per $cm^2$ will be detected in the output register circuit O.R.

The shape of the anode 5*a* is arranged to give the optimum electric field values, optimum collection of the ion current and optimum transmission of photons to the cathode. The thickness of the metal anode and feedthrough 5*b* must be sufficient to carry the signal current without destruction due to heat or to ageing processes due to ion bombardment. The upper limit of feedthrough thickness is set by the need to seal the cavity around the feedthrough.

As with the existing cold cathode tubes, the gas discharge occurs in bursts, due to the triggering of the process by a photoelectron followed by rapid quenching of the ionisation. These bursts are registered by a digital counting register O.R. The minimum size of the cavity 4 is determined by the minimum magnitude of electrical signal which a digital counter will register.

In arriving at the cavity depth of 3 μm (ten times smaller than the spacing for the known discharge tube) it was necessary to establish that the number of collisions between ions would be sufficient to cause avalanche multiplication. At a gas pressure of 100 torr, the mean free path of an ion is about 0.5 micrometres, giving 6–10 collisions over a discharge length of 3 micrometres. The system voltage can then be established at a cost-effective value in the region of 30V, ten times lower than for the known discharge tubes, with important safety benefits in hazardous environments. Likewise it will be noted that the transducer as described is very considerably smaller than a conventional discharge tube, and scope exists for further miniaturisation.

Mounting of the transducer device is achieved by attaching the semiconductor (cathode) cover sheet I to a gold-plated metal disc (header) with solder. The header is kept at ground potential. A wire is attached to the anode contact pad 5*c* by conventional means and is led to a positive power supply and the detector circuitry.

Two examples of devices will be described using multiple arrays of the transducer formed in one block. Such devices can provide imaging capability and also sensitivity at a number of wavelength threshold values.

EXAMPLE 1

Multielement Sensor for Image Formation

A normal feature of the manufacturing process for the transducer is the production of sensors in arrays several tens of units square. That is, the space between a large-area silicon wafer (cathode) and a large area glass plate substrate is occupied by multiple cavities and addressed by multiple anode electrodes. Leads can be provided in the structure so that these sensors can be addressed in situ. If the image of, say, a flame is focussed upon the array by UV optics, the resulting signals may be displayed or analysed by video techniques. Characteristics of the flame not detectable by a point sensor can thereby be determined. These include its shape, its fluctuation with time and any characteristic internal structure such as occurs with a flame in a natural gas burner. In flame detection, the additional information provided will greatly reduce false alarms for example those due to sunlight or welding torches. The image definition possible with this integrated sensor array is much higher than is possible with the known discharge tubes.

EXAMPLE 2

Multielement Sensor for Spectrum Measurement

By depositing coatings on the photocathode 1, the threshold wavelength for electron emission can be controlled. Several different coatings can be deposited in different areas of the silicon wafer cathode, in register with different cavities and anodes in the array of transducers. The result of such a manufacturing method is an array which detects the spectral characteristics of the light falling on it. Leads can be provided in the structure so that these elements can be addressed in situ. The spectrum of light from a UV source, focussed upon the array by UV optics, can therefore be analysed. Characteristics of the source not detectable by a single sensor can thereby be determined. These include the chemical composition and temperature of a flame. This feature will greatly reduce false alarms due to sunlight or welding torches in flame detection and have uses in scientific investigations of incandescent sources.

We claim:

1. A light-activated transducer comprising:

a transparent electrically-insulating substrate, an electrode structure applied to a surface of the substrate and supported thereby and comprising an electrode portion having at least one aperture for passage therethrough of light which has passed through the substrate, a contact pad spaced from the electrode portion, and an electrical feedthrough connecting the electrode portion to the contact pad, an insulator layer adhered to said surface of the substrate and on the feedthrough, and surrounding the electrode portion while leaving uncovered the contact pad and the electrode portion and a corresponding region of the substrate, a conductive or semiconductive cover sheet adhered to the insulator layer and supported thereby in spaced overlying relationship with the electrode portion and the corresponding region of the substrate and forming therewith, and with the surrounding insulator layer, a sealed cavity, and an ionisable gaseous filling disposed within said cavity.

2. A light-activated transducer comprising:

a transparent electrically-insulating substrate;

a plurality of electrode structures supported by a surface of said substrate, each of said electrode structures comprising an electrode portion having an aperture for passage therethrough of light which has passed through said substrate, a contact pad spaced from the electrode portion, and an electrical feedthrough connecting the electrode portion to the contact pad;

an insulator layer adhered to said surface of said substrate and on each of said feedthroughs, said insulator layer surrounding said electrode portions while leaving uncovered said contact pads, said electrode portions, and regions of said substrate corresponding to each of said apertures;

a conductive or semiconductive cover sheet adhered to said insulator layer and supported thereby in spaced overlying relationship with said plurality of electrode portions and said corresponding regions of the substrate and forming therewith, and with the surrounding insulator layer, a plurality of sealed cavities corresponding to said regions of the substrate; and an ionisable gaseous filling disposed within each of said cavities.

3. A transducer as claimed in claim 1 wherein the substrate is of glass.

4. A transducer as claimed in either claim 1 or 2, wherein the cover sheet is of single-crystal silicon.

5. A transducer as claimed in claim 1 wherein the electrode structure applied to the surface of the substrate is of metal deposited on the substrate surface.

6. A transducer as claimed in claim 5, wherein the electrode structure is of two-layer construction, comprising a first layer deposited on the substrate surface and having good adhesion thereon and a second layer deposited on the first layer and of lower electrical resistivity than the first layer.

7. A transducer as claimed in claim 1 wherein the insulator layer surrounding the electrode portion of the electrode structure is of silicon dioxide or silicon nitride.

8. A transducer as claimed in claim 1 wherein the insulator layer surrounding the electrode portion of the electrode structure is an apertured of insulating material.

9. A transducer as claimed in either claim 1 or 2, wherein the insulator layer is bonded to the substrate and to the cover sheet by means of electrostatic bonding.

10. A transducer as claimed in claim 1 wherein the spacing between the electrode portion of the electrode structure and the overlying cover sheet is in the range of 2 to 200 micrometres.

11. A transducer as claimed in claim 1 or 2, further comprising means for causing a predetermined area of said conductive or semiconductive cover sheet to respond to a predetermined spectral characteristic of said light having passed through the substrate.

12. A light-activated transducer as claimed in claim 1, wherein said electrode structure further comprises a mesh structure disposed within said electrode portion, said mesh structure forming a plurality of said aperture within said electrode portion.

13. A transducer as claimed in claim 2, further comprising addressing means for identifying at least one of said cavities as receiving said light which passed through the substrate.

14. A transducer as claimed in claim 2, wherein each of said electrode structures applied to the surface of the substrate comprises metal deposited on the substrate surface.

15. A transducer as claimed in claim 2, wherein each of said electrode structures is of two-layer construction, comprising a first layer deposited on the substrate surface and having good adhesion thereon and a second layer deposited on the first layer and of lower electrical resistivity than the first layer.

16. A transducer as claimed in claim 2, wherein the insulator layer comprises silicon dioxide or silicon nitride.

17. A transducer as claimed in claim 2, wherein the insulator layer surrounding the electrode portion of each of said electrode structures comprises an apertured sheet of insulating material.

18. A transducer as claimed in claim 2, wherein the insulator layer is bonded to the substrate and to the cover sheet by means of electrostatic bonding.

19. A transducer as claimed in claim 2, wherein the spacing between the electrode portion of each of said electrode structures and the overlying cover sheet is in the range of 2 to 200 micrometers.

20. A method of making a light-activated transducer, comprising the steps of:

applying to a surface of a transparent electrically-insulating substrate an electrode structure comprising an electrode portion having at least one aperture for passage therethrough of light which has passed through the substrate, a contact pad spaced from the electrode portion, and an electrical feedthrough connecting the electrode portion to the contact pad, adhering on said surface of the substrate and on the feedthrough an insulator layer formed to surround the electrode portion while leaving uncovered the contact pad and the electrode portion and a corresponding region of the substrate, and applying, in an ionisable gaseous atmosphere, a conductive or semiconductive cover sheet on the insulator layer such that said cover sheet adheres to said insulator layer and such that said cover sheet is supported in spaced overlying relationship with the electrode portion and the corresponding region of the substrate in order to form a sealed cavity filled with said atmosphere.

21. A method of making a light-activated transducer, comprising the steps of:

applying to a surface of a transparent electrically-insulating substrate a plurality of electrode structures, each of said electrode structures comprising an electrode portion having an aperture for passage therethrough of light which has passed through the substrate, a contact pad spaced from the electrode portion, and an electrical feedthrough connecting the electrode portion to the contact pad, adhering on said surface of the substrate and on the feedthroughs an insulator layer formed to surround the electrode portions while leaving uncovered the contact pads and the electrode portions and corresponding regions of the substrate, and applying in an ionisable gaseous atmosphere, a conductive or semiconductive cover sheet on the insulator layer such that said cover sheet adheres to said insulator layer and such that said cover sheet is supported in spaced overlying relationship with the electrode portions and the respective corresponding regions of the substrate in order to form a plurality of respective sealed cavities, each filled with said atmosphere.

* * * * *